US009063445B2

(12) United States Patent
Goan et al.

(10) Patent No.: US 9,063,445 B2
(45) Date of Patent: Jun. 23, 2015

(54) TONER FOR ELECTROSTATIC IMAGE DEVELOPMENT, PRODUCTION METHOD OF THE TONER AND IMAGE FORMATION METHOD

(71) Applicant: Konica Minolta, Inc., Tokyo (JP)

(72) Inventors: Kazuyoshi Goan, Sagamihara (JP); Mikio Kouyama, Kunitachi (JP); Hajime Tadokoro, Yokohama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/202,411

(22) Filed: Mar. 10, 2014

(65) Prior Publication Data

US 2014/0272694 A1 Sep. 18, 2014

(30) Foreign Application Priority Data

Mar. 18, 2013 (JP) ..... 2013-054726

(51) Int. Cl.
*G03G 9/08* (2006.01)
*G03G 9/087* (2006.01)

(52) U.S. Cl.
CPC ..... *G03G 9/0874* (2013.01); *G03G 9/08711* (2013.01); *G03G 9/08722* (2013.01); *G03G 9/08724* (2013.01); *G03G 9/08726* (2013.01); *G03G 9/08735* (2013.01); *G03G 9/08744* (2013.01); *G03G 9/08791* (2013.01)

(58) Field of Classification Search
CPC ..... G03G 9/08711; G03G 9/0874
USPC ..... 430/109.3
See application file for complete search history.

(56) References Cited

U.S. PATENT DOCUMENTS

| | | | |
|---|---|---|---|
| 4,910,114 | A | 3/1990 | Hosino et al. |
| 5,976,753 | A | 11/1999 | Wilson et al. |
| 2011/0020743 | A1 | 1/2011 | Hirakata et al. |

FOREIGN PATENT DOCUMENTS

| | | | |
|---|---|---|---|
| JP | S63-094251 | | 4/1988 |
| JP | 2004-191618 | A | 7/2004 |
| JP | 2004-271638 | A | 9/2004 |
| JP | 2009-057294 | A | 3/2009 |
| JP | 2010-043203 | A | 2/2010 |
| JP | 2012-107228 | A | 6/2012 |
| WO | WO03/008510 | A1 | 1/2003 |
| WO | WO2010/089943 | A1 | 8/2010 |

OTHER PUBLICATIONS

Extended European Search Report dated Jun. 18, 2014 for EP Application No. 14159751.8.

*Primary Examiner* — Mark A Chapman
(74) *Attorney, Agent, or Firm* — Lucas & Mercanti, LLP

(57) ABSTRACT

The present invention provides a toner for electrostatic image development that suppresses the fluctuation of electrostatic charge amount in accordance with environmental fluctuation and has good color reproducibility (wide color gamut), a producing method of the toner, and an image forming method using the toner for electrostatic image development. The toner for electrostatic image development of the invention includes a toner particle that contains at least a binder resin. The toner particle includes a polymer having a structural unit represented by a following general formula (1) as the binder resin.

General formula (1):

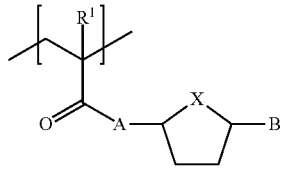

where $R^1$ represents a hydrogen atom or substituted or unsubstituted C1-C2 alkyl group, A represents an oxygen atom or divalent linking group, B represents a hydrogen atom, substituted or unsubstituted C1-C4 alkyl group, aldehyde group, carboxy group or hydroxy group, and X represents an oxygen atom, nitrogen atom or sulfur atom.

10 Claims, No Drawings

TONER FOR ELECTROSTATIC IMAGE DEVELOPMENT, PRODUCTION METHOD OF THE TONER AND IMAGE FORMATION METHOD

CROSS REFERENCE TO RELATED APPLICATION

This Application claims the priority of Japanese Patent Application No. 2013-054726 filed on Mar. 18, 2013, which is incorporated by reference herein.

TECHNICAL FIELD

The present invention relates to a toner for electrostatic image development and a method for producing the toner. The present invention also relates to a method for forming an image using the toner for electrostatic image development. More specifically, the present invention relates to a toner for electrostatic image development that is capable of suppressing a decrease of an amount of electric charge under high temperature and high humidity, and a method for producing the toner.

BACKGROUND ART

In an electrophotography technology in recent years, a low-energy fixing device (low temperature fusing) is under development for reducing electrical power consumption and high-speed printing since energy conservation is widely requested. However, there was a problem that thermal stability of a toner for electrostatic image development (also referred to simply as a "toner" hereinafter) was reduced as the low temperature fusing was developed and heat resistant storage of the toner during storage and transportation might become insufficient.

There was another problem that since a component such as a colorant or a release agent is exposed on a surface of the toner, it was difficult to render stable electrostatic chargeability to the toner for a long time. To solve these problems a technique to improve toner performance using a core-shell structure, in which a surface of the toner is covered with a resin, has been proposed until now (see Patent Literatures 1 and 2, for example).

On the other hand, it has been sought a departure from high environmental load-materials derived from petroleum that emits green house gases such as a carbon dioxide, by putting the Law Concerning the Promotion of Procurement of Eco-friendly Goods and Services by the State and Other Entities (Law on promoting green purchasing), for example, into effect. Consequently, it is now requested to use biomass resources as low environmental load materials instead of the materials derived from petroleum. Patent Literatures 3 to 5, for example, disclose such biomass resources.

In particular, Patent Literature 5 discloses a technique to produce a binder resin containing a compound having a furfural structure form biomass as a binder resin that is excellent to render low temperature fusing property and storability to the toner.

However, there is a possibility that, when the compound having a furfural structure is used for a binder resin, the binder resin may be colored or oxidized into brown. In addition, the binder resin tends to interact with moisture in the air under high temperature and high humidity conditions and that may cause a fluctuation of amount of electrostatic charge (charge amount) in accordance with environmental fluctuation.

Therefore, the binder resin is not suitable for use of a color toner since it may interrupt good coloring of the color toner.

PRIOR ART LITERATURE

Patent Literature

PATENT LITERATURE 1: JP2004-191618A
PATENT LITERATURE 2: JP2004-271638A
PATENT LITERATURE 3: JP2009-57294A
PATENT LITERATURE 4: JP2010-043203A
PATENT LITERATURE 5: JP2012-107228A

SUMMARY OF THE INVENTION

Problem to be Solved by the Invention

The present invention was made in light of the above problem and situation, and an object of the invention is to provide a toner for electrostatic image development that suppresses the fluctuation of amount of electrostatic charge in accordance with environmental fluctuation and has good color reproducibility (wide color gamut), a producing method of the toner, and a method for forming an image using the toner for electrostatic image development.

Means to Solve the Problem

The present inventors have investigated the problem and found that a toner for electrostatic image development that contains a compound having a furfural structure as a binder resin can be improved its transparency and thus color reproducibility of the toner can be kept by converting the furan ring in the furfural structure into a saturated heterocycle (referred to as a "saturated heterocycle" or "heterocycle-saturated" hereinafter) by a hydrogenation reaction. In addition, the present inventors have found that the toner for electrostatic image development having the heterocycle-saturated furan ring has a property that the fluctuation of electrostatic charge amount caused by environmental fluctuation is suppressed because an interaction between the toner and moisture is suppressed and thus an interaction between the toner and moisture in the air can be suppressed even under high temperature and high humidity.

To achieve at least one of the abovementioned objects, a toner for electrostatic image development reflecting one aspect of the present invention contains a toner particle that contains at least a binder resin. The toner particle contains a polymer having a structural unit represented by a following general formula (1) as the binder resin.

General formula (1)

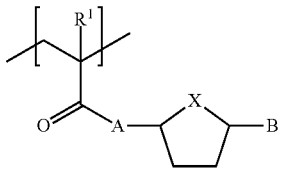

In the formula (1), $R^1$ represents a hydrogen atom or substituted or unsubstituted C1-C2 alkyl group, A represents an oxygen atom or divalent linking group, B represents a hydrogen atom, substituted or unsubstituted C1-C4 alkyl group, aldehyde group, carboxy group or hydroxy group, and X represents an oxygen atom, nitrogen atom or sulfur atom.

In the above toner for electrostatic image development, preferably the X in the formula (1) represents an oxygen atom.

In the above toner for electrostatic image development, preferably the polymer is a copolymer that contains the structural unit represented by the general formula (1) and a structural unit derived from a (meth)acrylate ester-based monomer.

In the above toner for electrostatic image development, preferably the polymer is a copolymer that contains the structural unit represented by the general formula (1), a structural unit derived from a (meth)acrylate ester-based monomer, and a structural unit derived from a styrene-based monomer.

To achieve at least one of the abovementioned objects, a producing method of the toner for electrostatic image development above described reflecting one aspect of the present invention includes steps of producing a monomer having a furfural structure, hydrogenating (adding hydrogen to) a furan ring in the furfural structure in the monomer that is produced at the monomer producing step, and polymerizing the monomer that is hydrogenated at the hydrogenating step.

To achieve at least one of the abovementioned objects, a producing method of the toner for electrostatic image development above described reflecting one aspect of the present invention includes steps of producing a monomer having a furfural structure, polymerizing the monomer that is produced at the monomer producing step, and hydrogenating a furan ring in the furfural structure in the polymer that is polymerized at the polymerizing step.

To achieve at least one of the abovementioned objects, an image forming method reflecting one aspect of the present invention includes steps of charging a photoreceptor, exposing the photoreceptor that is charged at the charging step so as to form an electrostatic latent image, developing the electrostatic latent image that is formed at the exposing step by using a toner for electrostatic image development, and transferring a toner image that is developed at the developing step onto a transfer material, and in which the toner for electrostatic image development is the toner for electrostatic image development described above.

EMBODIMENTS TO CARRY OUT THE INVENTION

The toner for electrostatic image development according to the present invention includes a toner particle that contains at least a binder resin. The toner particle contains a polymer having a structural unit represented by the general formula (1) as the binder resin. The feature is a common technical feature to the aspects of the present invention described above.

By virtue of the above feature, a toner for electrostatic image development that suppresses a fluctuation of charge amount caused by environmental fluctuation and has excellent color reproducibility, a producing method of the toner, and an image forming method using the toner for electrostatic image development can be provided.

Particularly, the above problem which occurs when a compound having a furfural structure was used in a toner for electrostatic image development can be solved by employing the configuration of the present invention.

Although an exerting mechanism or functional mechanism of the present invention is not clear, it is concluded as follows.

A furan ring in a furfural structure has a possibility that it may be browned by oxidation. Consequently, a toner containing a compound having a furfural structure could not be used as a color toner. However, in the toner for electrostatic image development of the invention, a toner particle includes a polymer having a structural unit represented by the general formula (1) in which the furan ring in the furfural structure is heterocycle-saturated by hydrogenation as a binder resin. As a result, the browning by an oxidation can be suppressed. This is the supposed reason why transparency is improved and color reproducibility can be kept even when a toner containing a compound having the furfural structure is used.

The furan ring in the furfural structure tends to interact (couple) with moisture and particularly tends to interact with moisture under high temperature and high humidity conditions. Thus a toner containing a compound having the furfural structure sometimes generates fluctuation of charge amount caused by environmental change. In the present invention, however, a toner particle contains a polymer having a structural unit represented by the general formula (1) in which the furan ring in the furfural structure is heterocycle-saturated by hydrogenation as a binder resin. As a result, an interaction between the toner and moisture can be suppressed. This is the supposed reason that an interaction between the toner and moisture can be suppressed even under high temperature and high humidity conditions and thus the fluctuation of charge amount caused by environmental change can be suppressed.

In an embodiment of the invention, it is preferable that X in the general formula (1) is an oxygen atom from the viewpoint of making the effect of the invention apparent. By virtue of this feature, an effect can be obtained that the fluctuation of charge amount caused by environmental fluctuation can be more suppressed and the color reproducibility can be more improved.

In an embodiment of the invention, it is preferable that the polymer is a copolymer that contains the structural unit represented by the general formula (1) and a structural unit derived from a (meth)acrylate ester-based monomer. By virtue of this feature, it becomes possible to obtain an effect that the fluctuation of charge amount caused by environmental fluctuation can be suppressed as well as that sufficient low temperature fusing property can be obtained.

In an embodiment of the invention, it is preferable that the polymer is a copolymer that contains the structural unit represented by the general formula (1), a structural unit derived from a (meth)acrylate ester-based monomer, and a structural unit derived from a styrene-based monomer. By virtue of this feature, it becomes possible to obtain an effect that the fluctuation of charge amount caused by environmental fluctuation can be suppressed as well as that sufficient low temperature fusing property can be obtained.

According to a producing method of the toner for electrostatic image development of the present invention, it is preferable to include a step of producing a monomer having a furfural structure, a step of hydrogenating a furan ring in the furfural structure in the monomer that is produced in the monomer producing step, and a step of polymerizing the monomer that is hydrogenated in the hydrogenating step because the method can reduce an environmental load caused by production of a toner for electrostatic image development. In addition, it is preferable from the viewpoint of production cost since the monomer produced in the monomer production step is hydrogenated rather than hydrogenation after polymerization.

According to a producing method of the toner for electrostatic image development of the present invention, it is possible to include a step of producing a monomer having a furfural structure, a step of polymerizing the monomer that is produced in the monomer producing step, and a step of hydrogenating a furan ring in the furfural structure in the polymer that is polymerized in the polymerizing step. Such a producing method can also reduce an environmental load caused by production of a toner for electrostatic image development and is preferable.

The toner for electrostatic image development of the present invention is preferably used in a image forming method including a step of charging a photoreceptor, a step of exposing the photoreceptor that is charged in the charging step so as to form an electrostatic latent image, a step of developing the electrostatic latent image that is formed in the exposing step by using the toner for electrostatic image development, and a step of transferring a toner image that is developed in the developing step onto a transfer material. It becomes possible to obtain an effect that an image of excellent color reproduction can be formed.

The present invention, its structural elements and embodiments and modes to carry out the invention will be explained below. Note that the term "X to Y" in the description means encompassing the former (X) and latter (Y) values as the lower limit and the higher limit, respectively.

(Outline of a Toner for Electrostatic Image Development)

The toner for electrostatic image development of the present invention is a toner for electrostatic image development including a toner particle containing at least a binder resin and the toner particle contains a polymer that contains the structural unit represented by the general formula (1) as the binder resin.

General formula (1)

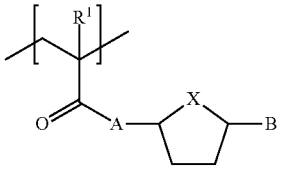

In formula (1), $R^1$ represents a hydrogen atom or substituted or unsubstituted C1-C2 alkyl group, A represents an oxygen atom or divalent linking group, B represents a hydrogen atom, substituted or unsubstituted C1-C4 alkyl group, aldehyde group, carboxy group or hydroxy group, and X represents an oxygen atom, nitrogen atom or sulfur atom.

(Structural Unit Represented by General Formula (1))

In the formula (1), examples of the divalent linking group (A in the formula) include an alkylene group, arylene group, ester group, ether group, amide group, amino acid residue, and combination of these two groups or more. The divalent linking group may be unsubstituted or has a substituent.

The X in the formula (1) is preferably an oxygen atom. By virtue of this feature, it becomes possible to obtain an effect that the fluctuation of charge amount caused by environmental fluctuation can be more suppressed and color reproducibility can be more improved.

(Polymer Having Structural Unit Represented by Formula (1))

A polymer of the present invention having the structural unit represented by the general formula (1) (referred to also as "polymer of the invention" hereinafter) can be obtained by polymerization or co-polymerization of a polymerizable monomer containing the structural unit represented by the general formula (1) (referred to also as "polymerizable monomer of the invention" hereinafter).

The polymerizable monomer of the invention can be synthesized by, for example, an esterification reaction of a saturated or unsaturated heterocycle-containing compound having a hydroxyalkyl group and a (meth)acrylic acid or its derivative, or elongating an alkylene oxide chain by reacting a heterocycle-containing compound and an alkylene oxide followed by reaction with a (meth)acrylic acid.

When the polymerizable monomer of the invention was synthesized from an unsaturated heterocycle-containing compound, the polymer of the invention may be synthesized by polymerizing the polymerizable monomers synthesized above and hydrogenating the polymer. Instead of the above, the polymer of the invention may be synthesized by hydrogenating the polymerizable monomer of the invention to produce a saturated heterocycle-containing compound, reacting the compound with a methacryloyl acid or its derivative and polymerizing the products.

As to the hydrogenation reaction, any known method can be used for producing a saturated heterocycle from an unsaturated heterocycle. Among them, an example is a method reported by Wei-Lin Wei, et al, Reactive & Functional Polymer (2004), 59, 33-39. Specifically, a hydrogenated target compound can be obtained by reacting a heterocycle with a hydrogen gas under the normal temperature and the normal pressure using a previously-prepared silica-alginic acid-amino acid-platinum complex as a catalyst.

The toner for electrostatic image development of the invention can preferably reduce an environmental load since the compound having the structural unit represented by the general formula (1) is derived from a 5-hydroxymethyl furfural and it is synthesized from biomass resources such as starch, cellulose or inulin.

An example of a method for synthesizing the polymerizable monomer of the invention is shown below by way of a reaction formula (1-a) which a 5-hydroxymethyl furfural is a starting material.

Reaction formula (1-a)

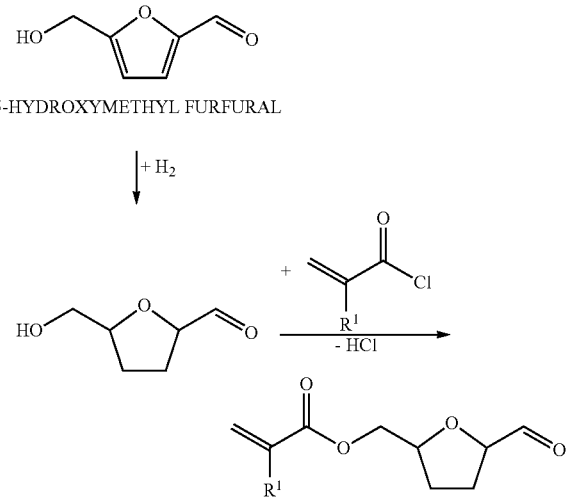

In the reaction formula (1-a), at first a mixture of the silica-alginic acid-amino acid-platinum catalyst, 5-hydroxymethyl furfural and ethanol is treated with removal of hydrogen and injection of hydrogen repeatedly at a temperature of 30° C. under water vapor pressure of 1 atmospheric pressure to hydrogenate the 5-hydroxymethyl furfural. After the reaction, the catalyst complex is removed by filtration to obtain 5-hydroxymethyl cyclofuran which is hydrogenated. A methylene chloride solution of the thus obtained 5-hydroxymethyl cyclofuran and triethylamine is added with methacryloyl chloride by drip at 0° C. under nitrogen gas flow. The solution is stirred a day at room temperature to prepare a reaction liquid mixture. The reaction liquid mixture is washed with HCl, saturated $NaHCO_3$ solution and saturated NaCl solution, dried with $MgSO_4$ anhydride and then filtered. The filtrate is evaporated under reduced pressure to remove a solvent and a raw material of the polymerizable monomer of the invention is obtained. The polymerizable monomer of the invention can be fractionated by developing the raw material using a silica-gel chromatography with a n-hexane/ethyl acetate mixed solution as a developing solvent.

An example of the silica-alginic acid-amino acid-platinum catalyst is a silica-alginic acid-glutamic acid-platinum catalyst. Such a catalyst can be synthesized as follows.

A sodium alginate is dissolved in distilled water and L-glutamic acid is dissolved in distilled water in a separate bottle. The two solutions are mixed, added with silica gel and then added with HCl to precipitate. The precipitation is heated and pulverized, washed with distilled water until the pH becomes 7 and dried to obtain white-powdery silica-alginic acid-glutamic acid ligand. The obtained silica-alginic acid-glutamic acid ligand is heat-refluxed in ethanol with hexachloro-platinum (IV) hexahydrate under nitrogen atmosphere with stirring. After the reaction, the reaction product is filtered and dried to obtain gray-powdery silica-alginic acid-glutamic acid-platinum catalyst.

A method for synthesizing the polymerizable monomer of the invention is not limited to the reaction formula (1-a) but may be a reaction formula (1-b) or (1-c) as follows, for example.

In addition, although the reaction formula (1-a) represents a case when the "A" in the general formula (1) of the invention is "—O—$CH_2$-", it is not limited to that but the "A" may be an amino acid residue or ether group as shown by the reaction formula (1-b) or (1-c).

Reaction formula (1-b)

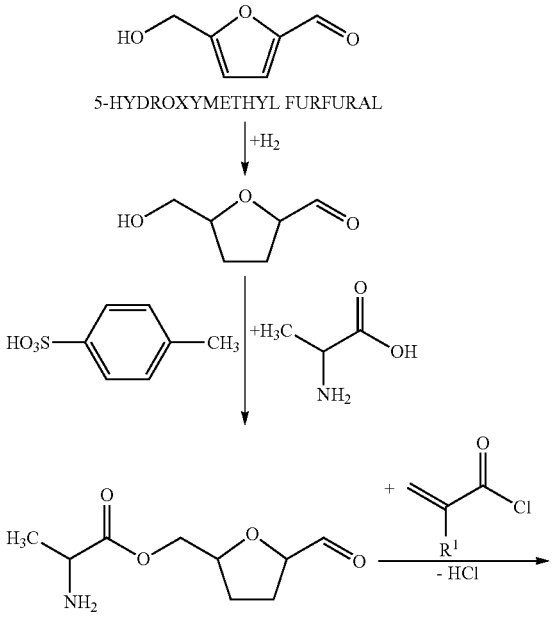

-continued

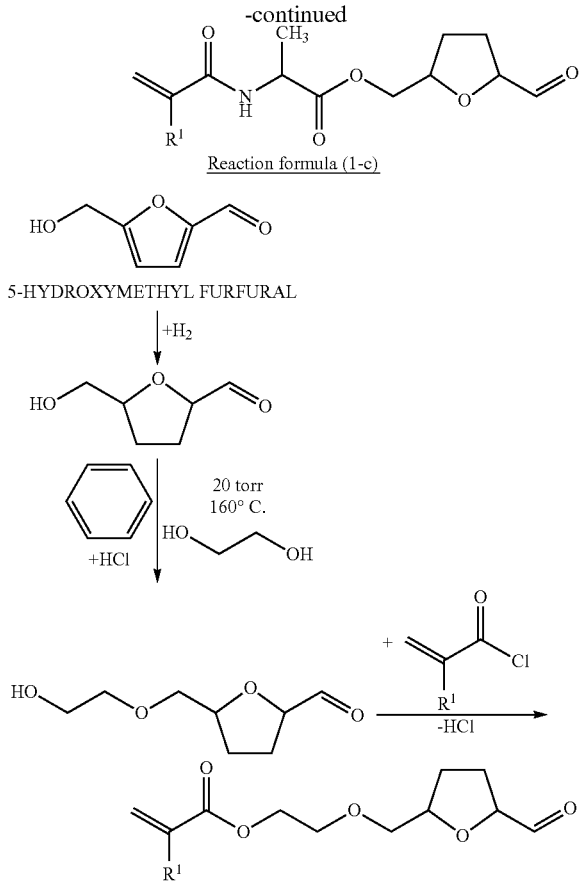

Reaction formula (1-c)

The polymer of the invention may be synthesized by polymerization of the monomer of the invention or copolymerization of the polymerizable monomer of the invention and other polymerizable monomer. A general polymerization reaction can be employed for the reaction and particularly a radical polymerization reaction can produce the polymer efficiently.

An example of a polymerization initiator used for the reaction may be a persulfate such as potassium persulfate, n-octyl-3-mercaptopropionate or azobisisobutylonitrile.

The polymer of the invention may be a mono-polymer composed of the polymerizable monomer of the invention only. Nevertheless, a copolymer composed of the polymerizable monomer of the invention and other polymerizable monomer is preferable.

The other polymerizable monomer that is copolymerizable with the polymerizable monomer of the invention is, for example, a (meth)acrylate ester-based monomer, styrene-based monomer or polymerizable monomer having an ionic dissociable group. Particularly, a (meth)acrylate ester-based monomer or styrene-based monomer is preferable as the other polymerizable monomer from the viewpoint of polymerization reaction stabilizing.

More preferably, the polymer of the invention is a copolymer having a structural unit represented by the general formula (1) and a structural unit derived from a (meth)acrylate ester-based monomer. The feature provides an effect of suppressing the fluctuation of charge amount caused by environmental difference as well as rendering low temperature fusing property as a binder resin.

The polymer of the invention may be a copolymer having a structural unit represented by the general formula (1), a structural unit derived from a (meth)acrylate ester-based monomer and a structural unit derived from a styrene-based monomer. Such a copolymer also provides an effect of suppressing the fluctuation of charge amount caused by environmental difference as well as rendering low temperature fusing property as a binder resin.

Examples of the (meth)acrylate ester-based monomer are an acrylate ester derivatives such as a methyl acrylate, ethyl acrylate, n-butyl acrylate, isopropyl acrylate, isobutyl acrylate, t-butyl acrylate, n-octyl acrylate, 2-ethylhexyl acrylate, cyclohexyl acrylate, stearyl acrylate, lauryl acrylate, phenyl acrylate, dimethylaminoethyl acrylate, and diethylaminoethyl acrylate; and a methacrylate ester derivatives such as a methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, cyclohexyl methacrylate, stearyl methacrylate, lauryl methacrylate, phenyl methacrylate, dimethylaminoethyl methacrylate, and diethylaminoethyl methacrylate. Among them, n-butyl acrylate and 2-ethylhexyl acrylate are preferable. These compounds may be used alone or in combination.

Examples of the styrene-based monomer are styrene, o-methyl styrene, m-methyl styrene, p-methyl styrene, α-methyl styrene, p-phenyl styrene, p-ethyl styrene, 2,4-dimethyl styrene, p-tert-butyl styrene, p-n-hexyl styrene, p-n-octyl styrene, p-n-nonyl styrene, p-n-decyl styrene, and p-n-dodecyl styrene and styrene derivatives. These compounds may be used alone or in combination.

In the toner for electrostatic image development of the invention, the content of the polymerizable monomer having the structural unit represented by the formula (1) is 27% or larger and 70% or smaller by mass relative to the total amount of monomers composing the polymer.

The molecular weight of the copolymer is preferably 1500 to 60000 and more preferably 3000 to 40000.

(Toner Production Method)

The toner of the invention can be produced by preparing toner particles by using the binder resin of the invention, a colorant and an internal additive as necessary and by adding an external additive as necessary.

The method for producing the toner of the invention is, for example, a pulverizing method, suspended polymerization method, mini-emulsion polymerization method, or any other known method. Among them, an emulsion coagulation method is preferable.

Specifically, it is preferable to produce the toner particle by mixing a dispersion liquid of fine particles of binder resin (also referred to as "binder resin fine particles" hereinafter) prepared by an emulsion-polymerization of the polymerizable monomer of the invention in a water-based medium and a dispersion liquid of fine particles of the colorant (also referred to as "fine colorant particles" hereinafter), coagulating the particles until desired diameter is obtained and further controlling the shape by performing fusion of the binder resin fine particles.

According to the emulsion coagulation method, downsizing of diameter of the toner particles can be easily achieved the toner can be produced stably at low cost.

The binder resin fine particles may contain internal additives such as a releasing agent, charge control agent and the like.

It is also possible to add fine resin particles of different type at the coagulation step so as to form toner particles having a core-shell structure.

In this application, the "water-based medium" means a medium of which the main component (50% by mass or more) is water. An example of a component other than water is a water-soluble organic solvent such as a methanol, ethanol, isopropanol, butanol, acetone, methylethylketone, or tetrahydrofuran. Among them, an alcohol organic solvent that does not dissolve the binder resin particles such as a methanol, ethanol or butanol is particularly preferable.

An example of an emulsion coagulation method as a toner production method will be described by following steps.

(1) A step of preparing a dispersion solution which the fine colorant particles are dispersed in a water-based medium,
(2) a step of preparing a dispersion solution which the binder resin fine particles are dispersed in a water-based medium,
(3) a step of mixing the fine colorant particles dispersion solution and the binder resin fine particles dispersion solution and forming toner particles by coagulating, engaging and fusing the fine colorant particles and the binder resin fine particles,
(4) a step of filtering the toner particles from the dispersion system of toner particles (water-based medium) and removing surfactant and the like,
(5) a step of drying the toner particles, and
(6) a step of adding external additives to the toner particles.

(Step 1)

Step 1 prepares a dispersion solution of the fine colorant particles in which the fine colorant particles are dispersed in the water-based medium.

The dispersion solution of the fine colorant particles can be prepared by dispersing the colorant in the water-based medium. It is preferable to conduct the colorant dispersion treatment under conditions that a concentration of surfactant in the water-based medium is the critical micelle concentration or more because it contributes to uniform colorant dispersion. A disperser for use of the colorant dispersion treatment may be any of the known dispersers. Any known surfactant can be used for the above purpose.

(Colorant)

A usable orange colorant for an orange toner is, for example, C.I. Solvent Orange 63, 68, 71, 72 or 78 as a dye and C.I. Pigment Orange 16, 36, 43, 51, 55, 59, 61 or 71 as a pigment.

A usable yellow colorant for a yellow toner is, for example, C.I. Solvent Yellow 19, 44, 77, 79, 81, 82, 93, 98, 103, 104, 112 and 162 as a dye and C.I. Pigment Yellow 14, 17, 74, 93, 94, 138, 155, 180 and 185 as a pigment. A combination thereof is also usable.

A usable magenta colorant for a magenta toner is, for example, C.I. Solvent Red 1, 49, 52, 58, 63, 111 and 122 as a dye and C.I. Pigment Red 5, 48:1, 53:1, 57:1, 122, 139, 144, 149, 166, 177, 178 and 222 as a pigment. A combination thereof is also usable.

A usable cyan colorant for a cyan toner is, for example, C.I. Solvent Blue 25, 36, 60, 70, 93 and 95 as a dye and C.I. Pigment Blue 1, 7, 15:3, 60, 62, 66 and 76 as a pigment.

A usable green colorant for a green toner is, for example, C.I. Solvent Green 3, 5 and 28 as a dye and C.I. Pigment Green 7 as a pigment.

A colorant for a black toner is, for example, a carbon black, magnetic material and iron-titanium composite oxide black and a usable example of the carbon black is channel black, furnace black, acetylene black, thermal black or lump black. An example of the magnetic material is ferrite or magnetite.

A content of the colorant is 0.5 to 20% by mass of the toner particle and more preferably 2 to 10% by mass.

(Step 2)

A resin particles dispersion solution which the binder resin fine particles containing the polymer of the invention are dispersed in the water-based medium is prepared in step 2.

As a preferred method for dispersing the binder resin fine particles, it is preferable to use an emulsion polymerization particles dispersion solution obtained by an emulsion polymerization.

(Binder Resin)

The binder resin composing the toner for electrostatic image development of the invention (referred to also as the "binder resin of the invention" hereinafter) contains a polymer having the structural unit represented by the general formula (1).

The binder resin of the invention may have a multilayer structure that is composed of two or more layers composed of binder resins of different compositions. A binder resin having such a structure, two-layer structure for example, may be obtained by preparing a dispersion solution of resin particles by a conventional emulsion polymerization process, adding a polymerization initiator and a polymerizable monomer to the dispersion solution and bringing the system into polymerization.

The binder resin of the invention is preferably produced by a production method including following steps (A-1) to (A-3).

(A-1) A monomer production step for producing a monomer having a furfural structure, (A-2) a hydrogen addition (hydrogenation) reaction step for adding hydrogen to furan rings of the furfural structures of the monomers obtained at the monomer production step, and (A-3) a polymerization step for polymerizing the monomers added with hydrogen at the hydrogen addition step.

A monomer having a furfural structure is produced from biomass resources, for example, in the monomer production step (A-1) of the production method described above. That is, the polymerizable monomer of the invention having a furfural structure is produced from a compound obtained from biomass resources, for example, using the synthesizing method of the polymerizable monomer of the invention described above.

It should be noted that, in the step (A-1), a raw material for producing the monomer having a furfural structure is not limited to biomass resources but any material such as a material derived from petroleum may be available as far as the polymerizable monomer of the invention can be synthesized.

In the hydrogen addition reaction step (A-2), the furan ring of the furfural structure of the monomer obtained by the monomer production step is added with hydrogen. Any known method described above for adding hydrogen to the furan ring may be employed for the hydrogen addition reaction step.

The monomers added with hydrogen in the hydrogen addition reaction step are polymerized in the polymerization step (A-3). The polymer having the structural unit represented by the general formula (1) can be obtained by the step. The reaction in the polymerization step can be represented by a following reaction formula (2). The number of "n" in the reaction formula (2) is preferably such that a molecular weight of the copolymer becomes within the range of 1500 to 60000.

Any general polymerization method described above may be employed for polymerizing the monomers in the polymerization step and in particular a radical polymerization reaction may be employed to obtain the polymer with high efficiency.

Reaction formula (2)

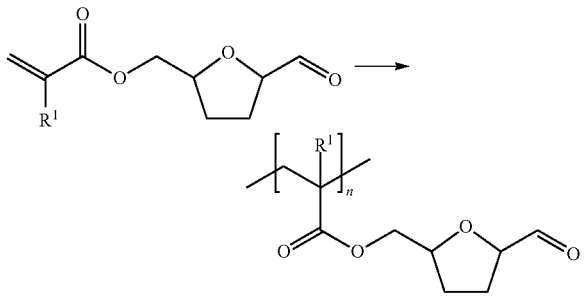

The binder resin of the invention may be produced by a production method including the following steps (B-1) to (B-3).

(B-1) A monomer production step for producing a monomer having a furfural structure, (B-2) a polymerization step for polymerizing the monomers obtained at the monomer production step, and (B-3) a hydrogen addition (hydrogenation) reaction step for adding hydrogen to furan rings of the furfural structures of the polymer obtained at the polymerization step.

A monomer having a furfural structure is produced from biomass resources, for example, in the monomer production step (B-1) of the production method described above. Examples of the monomers having a furfural structure produced from biomass resources are monomer A, monomer C and monomer E which are described later. A production method of the monomers A, C and E is not particularly limited. Any known method may be employed such as, for example, reactions represented by the (1-a) to (1-c) described above without the saturation reaction of the hetero ring.

It should be noted that, in the step (B-1), a raw material for producing the monomer having a furfural structure is not limited to biomass resources but any material such as a material derived from petroleum may be available as far as the polymerizable monomer of the invention can be synthesized.

A polymer is synthesized by polymerizing the monomers obtained in the monomer production step in the polymerization step (B-2). The polymerization step can be conducted using the polymerization method of the polymerizable monomer of the invention described above.

In the hydrogen addition reaction step (B-3), hydrogen is added to the furan ring of the furfural structure of the polymer obtained by the polymerization step of the monomers obtained by the monomer production step. As a result, the polymer having the structural unit represented by the general formula (1) is obtained. The hydrogen addition reaction to the furan ring in the hydrogen addition reaction step (B-3) may be conducted with the known method described above.

The monomer polymerization step (B-2) and the hydrogen addition reaction step (B-3) are carried out as described by a reaction formula (3) below. The number of "n" in the reaction formula (3) is preferably such that a molecular weight of the copolymer becomes within the range of 1500 to 60000.

A general polymerization method may be employed as described above for polymerization of the monomers in the polymerization step and in particular a radical polymerization reaction may be employed to obtain the polymer with high efficiency.

Reaction formula (3)

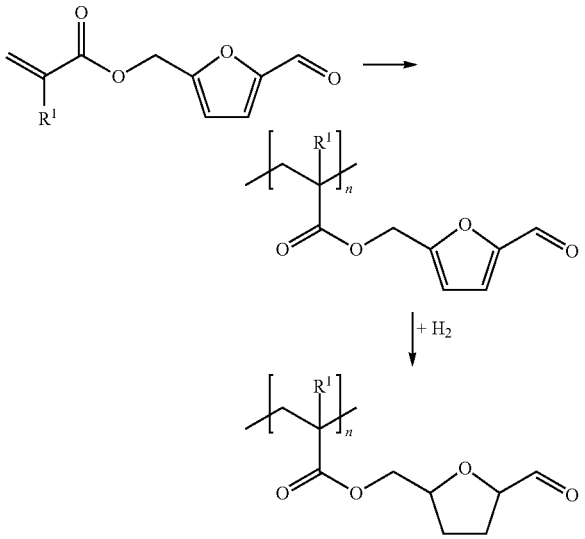

It is preferable to use biomass resources, for example, in the monomer production steps (A-1) and (B-1) since environmental load can be reduced. It is more preferable to use the production method including the steps (A-1) to (A-3) to reduce the production cost because the monomers are polymerized after hydrogenation and thus the emulsification and de-solvent cost can be eliminated compared with the method that polymerization is conducted before hydrogenation.

(Monomer Production Step (A-1) and (B-1): Example of Production from Biomass Resources)

An example of the biomass resources used for the step (A-1) or (B-1) is wood, grass or agricultural waste such as straw, oat and corn.

An example of a reaction in the production process to synthesize a monomer having a furfural structure from biomass resources is a method to produce a 5-hydroxymethyl furfural by a technique described in Patent Document JP2012-121811A as described below by making use of cellulose obtained from biomass resources of agricultural waste.

(C) Decomposing the cellulose to glucose using an enzyme such as cellulase.

(D) Producing 5-hydroxymethyl furfural from the glucose by the reaction represented by a reaction formula (4) below.

Reaction formula (4)

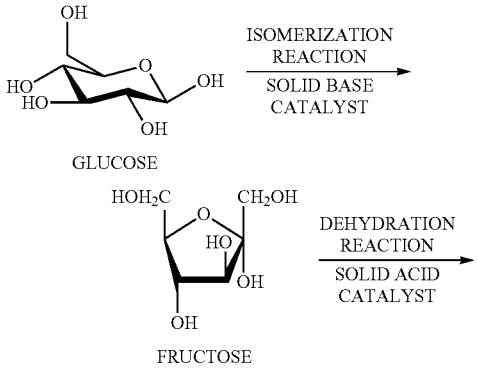

-continued

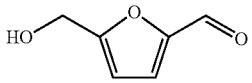

5-HYDROXYMETHYL FURFURAL

In the reaction formula (4), the solid base catalyst is preferably a layered double hydroxide (LDH).

The layered double hydroxide has a main skeleton of a sheet-shaped metal hydroxide.

A main example of the layered double hydroxide as a catalyst used in the reaction formula (4) is a hydrotalcite.

A general formula of the hydrotalcite is:

$$[M^{2+}_{1-X}M^{3+}_{X}(OH)_2][A^{n-}_{X/n}.mH_2O]$$

where $M^{2+}$ is a divalent metal ion, $M^{3+}$ is a trivalent metal ion, and $A^{n-}_{X/n}$ is an interlayer negative ion. The hydrotalcite compound is a layered clay mineral and is positively charged as a whole, and has a property that an anion is adsorbed between the layers and the surface of the compound and $OH^-$ and $CO_3^{2-}$ on the surface function as a base.

Among the hydrotalcites represented by the above general formula and used as a catalyst in the reaction formula (4), preferably used is a hydrotalcite of Mg—Al—$CO_3$ system.

While the solid acid catalyst is not limited as far as it functions as a solid acid, an ion exchange resin for an acid catalyst is preferable. An example of the solid acid catalyst is Amberlyst-15 (registered trade mark, Rohm and Haas Company) represented by a chemical formula (1) or Nafion (registered trade mark, Du Pont) represented by a chemical formula (2).

(Chemical formula (1))

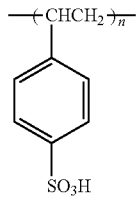

(Chemical formula (2))

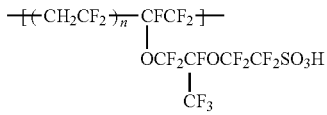

(Step 3)

In this step, the toner particles are formed by mixing the fine colorant particles dispersion solution and the fine resin particles dispersion solution and coagulating/fusing the fine colorant particles and the binder resin fine particles.

A method to coagulate and fuse the fine colorant particles and the binder resin fine particles is as follows. Each of the fine colorant particles dispersion solution and the fine resin particles dispersion solution are added with a flocculant and optionally mixed with a dispersion solution of magnetic powder, charge control agent, releasing agent and other components of the toner as necessary to prepare a coagulation dispersion solution. The coagulation dispersion solution is temperature-controlled so as to coagulate and fuse the particles in a water-based medium to form a toner particles dispersion solution.

A content of the toner particles composing the toner is preferably 98 to 100 parts by mass and more preferably 99 to 100 parts by mass relative to 100 parts by mass of the toner.

The toner of the invention may include a polyester resin obtained by polycondensing a conventional styrene-acrylic resin or polyol and a polycarboxylic acid in addition to the polymer of the invention. In this case, a content of the polymer of the invention in the toner is preferably 50 to 100% by mass and more preferably 70 to 100% by mass.

(Particle Size of Toner Particle)

A particle size of the toner particles composing the tone as described above is preferably 4 to 10 μm as a median value based on volume and more preferably 6 to 9 μm.

When the volume-based median value falls within the above range, transfer efficiency becomes high and an image quality of half tone is improved and an image quality of thin line and dot is improved.

The volume-based median value of the toner particles is measured and calculated using a measurement equipment of Coulter Multisizer 3 (Beckmann Coulter, Inc) connected with a computer system (Beckmann Coulter, Inc) for data processing.

Specifically, 0.02 g of the toner particles are added into 20 ml of a surfactant solution (for example, prepared by diluting neutral detergent containing surfactant component with pure water by ten times for dispersing the toner particles). An affinity between the toner particles and the solution is developed and the solution is dispersed by ultrasonic wave in 1 minute to form a toner particles dispersion solution. The toner particles dispersion solution is injected using a pipet into a beaker containing ISOTON II (Beckmann Coulter, Inc) disposed in a sample stand until a concentration displayed on the measurement equipment indicates 5 to 10%.

This range of the concentration helps to obtain measurement data of high repeatability. A count number of particles of the equipment is set as 25000 and aperture diameter is set as 50 μm and frequency values in the measurement range of 1 to 30 μm divided into 256 parts are calculated. The particle diameter at 50% of integrated volume percentage from larger side is determined as the volume-based median value.

The toner of the invention for use of image forming preferably has a mean roundness range of 0.930 to 1.000 from the viewpoint of improvement of transfer efficiency and more preferably in the range of 0.950 to 0.995.

The mean roundness of the toner of the invention is measured by FPIA-2100 (Sysmex Corporation).

Specifically, a sample is added into a surfactant-water solution and an affinity between them is developed. The solution is dispersed by ultrasonic wave in 1 minute and then images are captured using FPIA-2100 (Sysmex Corporation) in a HPF (high magnification image capturing) mode as a measurement condition within an appropriate concentration range of 3000 to 10000 particles detected in the HPF mode. A roundness of each toner particle is calculated according to a following equation (T), all of the roundness values of the particles are added and the sum is divided by the total number of toner particles.

roundness=(circumferential length of a circle having a projected area which is the same as that of a particle image)/(circumferential length of a projected image of the particle) Equation (T)

(Coagulating Agent)

A coagulating agent used for the present invention is not limited but is preferably selected from metal salts. Examples of the metal salts are, for example, a salt of monovalent metal such as an alkali metal such as sodium, potassium and lithium, a salt of divalent metal such as calcium, magnesium, manganese and copper and a salt of trivalent metal such as iron and aluminum.

Examples of the salts are sodium chloride, potassium chloride, lithium chloride, calcium chloride, magnesium chloride, zinc chloride, copper sulfate, magnesium sulfate and manganese sulfate. Among them, divalent metal salts are particularly preferable.

A divalent metal salt can promote coagulation even with a smaller amount of the salt. The divalent metal salt may be used alone or in combination.

(Magnetic Powder)

When the toner particles contain magnetic powder, magnetite, γ-hematite or various kinds of ferrite may be used as the magnetic powder.

A content of the magnetic powder is 10 to 500 parts by mass relative to 100 parts by mass of resin in the toner particle and more preferably 20 to 200 parts by mass.

(Charge Control Agent)

When the toner particles are formed by including a charge control agent, the charge control agent is not limited and any known materials may be used as far as it has a function to render positive or negative charge by friction charging.

Specifically, a nigrosine-based dye such as Nigrosine Base EX (Orient Chemical Industries Co., Ltd.), a quaternary ammonium salt such as Quaternary Ammonium Salt P-51 (Orient Chemical Industries Co., Ltd.) and Copycharge PX VP435 (Hoechist Japan Co., Ltd.), alkoxyl amine, alkylamide, molybdic acid-chelate pigments and imidazole compounds such as PLZ 1001 (Shikoku Chemicals Corporation) are taken as examples of a positive charge control agent. As for a negative charge control agent, a metal complex such as Bontron S-22, Bontron S-34, Bontron E-81 and Bontron E-84 (all from Orient Chemical Industries Co., Ltd.) and Spiron Black TRH (Hodogaya Chemical Co., Ltd.), thioindigo-based pigment, quaternary ammonium salt such as Copycharge NX VP434 (Hoechist Japan Co., Ltd.), calixarene compound such as Bontron E-89 (Orient Chemical Industries Co., Ltd.), boron compound such as LR147 (Japan Carlit Co., Ltd.) and fluorine compound such as magnesium fluoride and carbon fluoride are exemplified. Metal complexes having various kinds of structures can be used as a metal complex as a negative charge control agent. The examples are oxycarboxylic acid-metal complexes, dicarboxylic acid-metal complexes, amino acid-metal complexes, diketone-metal complexes, diamine-metal complexes, azo group-containing benzene-benzene derivative skeleton metal complexes and azo group-containing benzene-naphthalene derivative skeleton metal complexes.

The toner charging property is improved by forming the toner by including a charge control agent.

The content of the charge control agent is preferably 0.01 to 30% by weight and more preferably 0.1 to 10% by weight relative to the toner particle.

(Releasing Agent)

In the case where the toner particles contain releasing agent, any known wax can be used as the releasing agent. Preferable example of the wax is a polyolefin-based wax such as a low-molecular weight polypropylene or polyethylene or oxidized-type polypropylene or polyethylene.

The content of the releasing agent in the toner particles is preferably 1 to 30% by weight and more preferably 3 to 15% by weight.

(Step 4)

The toner particles are filtered from the dispersion solution (water-based medium) prepared in the step 3 and surfactant and the like is removed in this step 4.

(Step 5)

The toner particles obtained in the step 4 are dried in this step 5.

(Step 6)

In this step 5 the toner particles are added with an external additive to improve fluidity and charge property of the toner. The toner is thus produced.

(External Additive)

Examples of the external additive for the present invention are inorganic oxide fine particles such as silica fine particles, alumina fine particles and titanium oxide fine particles and inorganic fine particles such as inorganic stearate compound fine particles (e.g. aluminum stearate fine particles or zinc stearate fine particles) and inorganic titanate compound fine particles (e.g. strontium titanate or zinc titanate).

Particularly, silica fine particles having a mean diameter of 70 to 150 nm is preferable from the viewpoint of durability, cleaning property and transfer property.

The inorganic fine particles are preferably surface-treated with a silane coupling agent, titanium coupling agent, higher fatty acid or silicone oil from the viewpoint of heat-resistance and environmental stability.

An amount of addition of the external additive is in a range of 0.05 to 5 parts by mass and preferably 0.1 to 3 parts by mass relative to 100 parts by mass of the toner particles. Various external additives may be employed in combination.

A method for adding the external additive to the toner particles may be a dry method in which a powdered external additive is added to dried toner particles. A mixing apparatus may be a mechanical mixer such as a Henschel mixer or coffee mil.

(Developer)

The toner of the invention can be used as a two-components developer composed of a carrier and the toner or a single-component non-magnetic developer composed of the toner only.

The carrier, which is magnetic particles, used for the two-components developer may be any known material such as a metal such as iron, ferrite or magnetite or an alloy of the metal and a metal such as aluminum or lead. Among them, ferrite particles are preferable.

The carrier may be a coated carrier that a surface of a magnetic particle is coated with a coating agent such as a resin or a resin dispersed-type carrier that magnetic fine particles are dispersed in a binder resin.

A volume mean diameter of the carrier is preferably 15 to 100 μm and more preferably 25 to 80 μm.

(Method for Forming Image)

The toner of the invention can preferably be used for a method for forming an image that includes a charging step in which a photoreceptor is charged, an exposing step in which an electrostatic latent image is formed by exposing the photoreceptor charged in the charging step, a developing step in which the electrostatic latent image formed in the exposing step is developed by an electrostatic image developing toner, and a transferring step in which a toner image developed in the developing step is transferred on a transfer material. For example, the toner may be used for a method for forming a monochrome image or forming a full-color image. Any image forming method may be applied to the method for forming a full-color image. They are a four-cycles image forming method that is carried out using four color developing devices (for yellow, magenta, cyan and black) and an electrostatic latent image carrier (referred to also as an "electrophotographic photoreceptor" or simply as a "photoreceptor" hereinafter) and a tandem-type image forming method using image forming units for the colors each having a color developing device and an electrostatic latent image carrier for each color. An effect that a fluctuation of charge amount caused by environmental fluctuation can be suppressed and thus an image having excellent color reproducibility can be formed is obtained by using the toner of the invention.

Specifically, for example, a visible image may be formed as follows. An image is charged on an electrostatic latent image carrier using a charging device (charging step), an electrostatic latent image is formed by image-exposure (exposing step), and the toner for electrostatic image development of the invention is charged by a carrier of a developing agent and a toner image is formed by development (developing step). Then the toner image is transferred to a transfer material (such as a normal paper or transparent support) (transferring step) and the toner image transferred on the transfer material is fixed by a contact-heating fixing treatment (fixing step). A visible image is thus formed.

The means for charging, exposing, developing, transferring and fixing are not limited and common methods used in the electrophotographic process can be employed.

Example 1

An exemplary embodiment of the present invention will be described below without an intention to limit the invention thereto. In the description the term of "part" and "%" mean "part by mass" and "mass %", respectively, unless otherwise defined.

(Synthesis of Monomer)

(Synthesis of Monomer A)

A methacryloil chloride (8.5 ml, 105 mmol) was dropped to a methylene chloride solution (200 ml) of 5-hydroxymethyl furfural (12.6 g, 100 mmol) and triethylamine (29.2 ml, 210 mmol) at a temperature of 0° C. under nitrogen flow. The solution was stirred at the room temperature for one day to prepare a reaction solution. The reaction solution was washed with 1N—HCl (200 ml, twice), saturated $NaHCO_3$ water solution (200 ml, once) and saturated NaCl water solution (200 ml, once) and then dried with $Mg50_4$ anhydride and filtered. The filtrate solvent was distilled away under reduced pressure to obtain raw product of a monomer A. A silica gel column chromatography was performed using a n-hexane/ethylacetate mixed solution (4/1→2/1) as a developing solvent. Thus the monomer A was fractioned.

(Catalyst Synthesis 1)

A 20.0 g of sodium alginate was dissolved in 200 ml of distilled water and a 10.0 g of L-glutamic acid was dissolved in 100 ml of distilled water in another bottle. Both solutions were mixed, added with 30.0 g of silica gel, followed by 60 ml of 1M-HCl solution to generate precipitation. The precipitate was heated, crushed and washed with distilled water until the pH of the water became 7. The precipitate was dried to obtain 58.0 g of white powdery silica-alginic acid-glutamic acid ligand.

(Catalyst Synthesis 2)

10.0 g of the silica-alginic acid-glutamic acid ligand obtained at the "catalyst synthesis 1" and 1.04 g of platinum (IV) hexachloride hexahydrate were added into ethanol and heat-refluxed with stirring under nitrogen atmosphere for four hours. After the reaction, the reaction product was filtered and dried to obtain 10.0 g of gray powdery silica-alginic acid-glutamic acid-platinum catalyst.

(Synthesis of Monomer B)

5.0 g of the silica-alginic acid-glutamic acid-platinum catalyst obtained at the step of "Catalyst Synthesis 2" and 5-hydroxymethyl furfural (5.7 g, 45.0 mmol) were added to 500 ml of ethanol and the solution was treated by hydrogendegassing and hydrogen-injection alternately by 100 times at a temperature of 30° C. under steam pressure of 1 atm. After the reaction, the complex was filtered away and hydrogenated 5-hydroxymethyl cyclofuran was obtained.

A monomer B was obtained through the same process for obtaining the monomer A except that the 5-hydroxymethyl cyclofuran was used instead of the 5-hydroxymethyl furfural.

(Synthesis of Monomer C)

A monomer C was obtained through the same process for obtaining the monomer A except that a furfuryl alcohol was used instead of the 5-hydroxymethyl furfural.

(Synthesis of Monomer D)

A monomer D was obtained through the same process for obtaining the monomer A except that a tetrahydrofurfuryl alcohol was used instead of the 5-hydroxymethyl furfural.

(Synthesis of Monomer E)

A monomer E was obtained through the same process for obtaining the monomer A except that a methacrylic acid and 2-chloro thiophene were used instead of the 5-hydroxymethyl furfural and methacryloyl chloride, respectively.

(Synthesis of Monomer F)

A 2-chlorotetrahydrothiophene was obtained by hydrogenating a 2-chlorothiophene by the same process for obtaining the monomer B. A monomer F was obtained by the same process for synthesizing the monomer E except that the 2-chlorotetrahydrothiophene was used instead of the 2-chlorothiophene.

Chemical formulae of the monomers A to F obtained as explained above are as follows.

MONOMER A

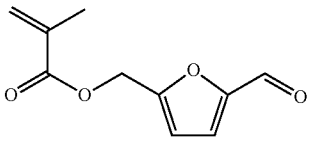

MONOMER B

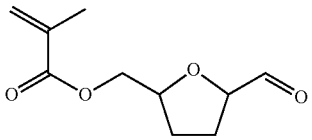

MONOMER C

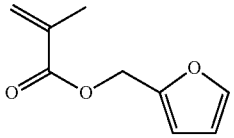

MONOMER D

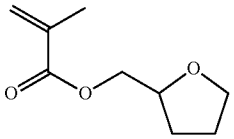

MONOMER E

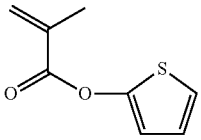

-continued

MONOMER F

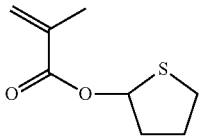

(Production of Orange Toner)

Orange Toner Production Example 1

(1) Preparation Step of Fine Colorant Particles Dispersion Solution

A surfactant water solution was prepared by adding 11.5 parts by mass of sodium n-dodecyl sulfate to 160 parts by mass of ion exchanged water and dissolved by stirring. A colorant (C.I. Pigment Orange 36) was gradually added by 15 parts by mass into the surfactant water solution and the solution was dispersion-treated using a mechanical disperser "Clearmix" (M Technique Co., Ltd.) to prepare a fine colorant particles dispersion solution "Or" in which the fine colorant particles were dispersed.

(2) Preparation of Fine Resin Particles Dispersion Solution "A1"

(a) First Step Polymerization

A surfactant solution which 4 parts by mass of poly(sodium oxyethylene(2)dodecylether sulfate) was dissolved in 3000 parts by mass of ion exchanged water was stored in a reaction vessel equipped with a stirrer, temperature sensor, cooling tube and nitrogen inlet equipment and the solution was heated up to 80° C. (internal temperature) with stirring at a rate of 230 rpm under nitrogen flow.

A polymerization initiator solution which 5 parts by mass of a polymerization initiator (potassium persulfate: KPS) was dissolved in 200 parts by mass of ion exchanged water was added in the surfactant solution and the solution temperature was adjusted at 80° C. After that a monomer-mixed solution composed of 560 parts by mass of monomer A, 240 parts by mass of butylacrylate and 68 parts by mass of methacrylic acid was mixed and dispersed to obtain a fine resin particles dispersion solution "A1-a".

(b) Second Step Polymerization

An emulsion dispersion solution "A1-b" containing emulsified particles was prepared by mixing and dispersing a monomer-mixed solution composed of 132 parts by mass of monomer A, 57 parts by mass of butylacrylate, 20 parts of methacrylic acid, 0.5 part by mass of n-octyl mercaptan and 82 parts by mass of "WEP-5" (NOF Corporation) using the mechanical disperser "Clearmix".

A surfactant solution which 2 parts by mass of poly(sodium oxyethylene(2)dodecylether sulfate) was dissolved in 1270 parts by mass of ion exchanged water was stored in a reaction vessel equipped with a stirrer, temperature sensor, cooling tube and nitrogen inlet equipment and the solution was heated up to 80° C. After that 40 parts by mass (solid content) of the fine resin particles dispersion solution "A1-a" was added with the above surfactant solution, the temperature was adjusted to 80° C. and further the emulsion dispersion solution "A1-b" was added.

A polymerization initiator which 5 parts by mass of potassium persulfate (KPS) was dissolved in 100 parts by mass of ion exchanged water was added with the solution and the system was stirred for one hour at 80° C. so as to polymerize. The fine resin particles dispersion solution "A1" was thus prepared.

(3) Formation of Toner Particles "A1"

1250 parts by mass of the fine resin particles dispersion solution "A1", 2000 parts by mass of ion exchanged water and 165 parts by mas of the fine colorant particles dispersion solution "Or" are stored in a reaction vessel equipped with a temperature sensor, cooling tube, nitrogen inlet equipment and stirrer, and the solution was stirred to prepare an association solution. An internal temperature of the association solution was adjusted at 30° C. and the pH was adjusted to 10.0 with 5 mol/l sodium hydroxide. After that a solution which 52.6 parts by mass of magnesium chloride hexahydrate was dissolved in 72 parts by mass of ion exchanged water was added with the association solution in 10 minutes under stirring at 30° C. After letting the solution stand in three minutes, heating was started and the solution was heated to 90° C. in 6 minutes (temperature rising rate: 10° C./min).

A mean diameter of associated particles was determined using "Multisizer 3" (Beckman Coulter Inc.) in that state. When a median diameter (volume basis) became 6.7 μm, a solution which 115 parts by mass of sodium chloride was dissolved in 700 parts by mass of ion exchanged water was added to the association solution to cease particle-growth, and the solution was kept heated and stirred for 6 hours at 90° C.±2° C. so as to keep particle-fusion. A mean degree of circularity of the associated particles was determined as 0.958 by FPIA-2100 (Sysmex Corporation).

Next, the solution was cooled to 30° C. at a rate of 6° C./min, the associated particles were filtered, washed with ion exchanged water at 45° C. repeatedly and dried by hot wind at 40° C. to obtain toner mother particles "A1".

An external additive composed of 1.0 part by mass of silica (mean primary diameter: 12 nm, degree of hydrophobic: 68) treated with hexamethylsilazane and 0.3 part by mass of titanium dioxide (mean primary diameter: 20 nm, degree of hydrophobic: 63) treated with n-octylsilane was added to 100 parts by mass of the toner mother particles "A1" and treated by a henschel mixer (MituiMiike Kogyousha) to prepare an orange tone "A1".

The treatment by the henschel mixer was carried out by the conditions of 35 m/sec peripheral speed of agitating wheel, 35° C. temperature and 15 minutes processing time.

Orange Toner Production Example 2

An orange toner "B1" was produced in the same way as that for producing the Orange Toner Production Example 1 except that a monomer B was used instead of the monomer A.

Orange Toner Production Example 3

An orange toner "C1" was produced in the same way as that for producing the Orange Toner Production Example 1 except that a monomer C was used instead of the monomer A.

Orange Toner Production Example 4

An orange toner "D1" was produced in the same way as that for producing the Orange Toner Production Example 1 except that a monomer D was used instead of the monomer A.

Orange Toner Production Example 5

An orange toner "E1" was produced in the same way as that for producing the Orange Toner Production Example 1 except that a monomer E was used instead of the monomer A.

Orange Toner Production Example 6

An orange toner "F1" was produced in the same way as that for producing the Orange Toner Production Example 1 except that a monomer F was used instead of the monomer A.

Orange Toner Production Example 7

(1) Preparation of fine resin particles dispersion solution "A2"

(a) First Step Polymerization

A fine resin particles dispersion solution "A2-a" was prepared in the same way as that explained in Orange Toner Production Example 1, (2), (a) except that a monomer-mixed solution composed of 400 parts by mass of monomer A, 200 parts by mass of styrene, 200 parts by mass of butylacrylate and 68 parts by mass of methacrylic acid was used.

(b) Second Step Polymerization

A fine resin particles dispersion solution "A2" was prepared in the same way as that explained in Orange Toner Production Example 1, (2), (b) except that a dispersion solution "A2-b" containing emulsified particles prepared by using a monomer-mixed solution composed of 94 parts by mass of monomer A, 48 parts by mass of styrene, 48 parts by mass of butylacrylate, 20 parts by mass of methacrylic acid, 0.5 part by mass of n-octylmelcaptan and 82 parts by mass of "WEP-5" (NOF Corporation) and a fine resin particles dispersion solution "A2-a" were used.

(2) Formation of toner particles "A2"

An orange toner "A2" was prepared in the same way as explained in Orange Toner Production Example 1, (3) except that a fine resin particles dispersion solution "A2" was used instead of the fine resin particles dispersion solution "A1".

Orange Toner Production Example 8

An orange toner "B2" was prepared in the same way as Orange Toner Production Example 7 except that the monomer B was used instead of the monomer A.

Orange Toner Production Example 9

An orange toner "C2" was prepared in the same way as Orange Toner Production Example 7 except that the monomer C was used instead of the monomer A.

Orange Toner Production Example 10

An orange toner "D2" was prepared in the same way as Orange Toner Production Example 7 except that the monomer D was used instead of the monomer A.

Orange Toner Production Example 11

An orange toner "E2" was prepared in the same way as Orange Toner Production Example 7 except that the monomer E was used instead of the monomer A.

Orange Toner Production Example 12

An orange toner "F2" was prepared in the same way as Orange Toner Production Example 7 except that the monomer F was used instead of the monomer A.

Production of Yellow Toner

Production Examples of Yellow Toner "A1" to "F1" and "A2" to "F2"

Yellow toners "A1" to "F1" and "A2" to "F2" were produced in the same ways as those of Orange Toner Production Example 1 to Orange Toner Production Example 12 except that a "C.I. Pigment Yellow 74" was used instead of the "C.I. Pigment Orange 36".

Production of Magenta Toner

Production Examples of Magenta Toner "A1" to "F1" and "A2" to "F2"

Magenta toners "A1" to "F1" and "A2" to "F2" were produced in the same ways as those of Orange Toner Production Example 1 to Orange Toner Production Example 12 except that a "C.I. Pigment Red 122" was used instead of the "C.I. Pigment Orange 36".

Production of Cyan Toner

Production Examples of Cyan Toner "A1" to "F1" and "A2" to "F2"

Cyan toners "A1" to "F1" and "A2" to "F2" were produced in the same ways as those of Orange Toner Production Example 1 to Orange Toner Production Example 12 except that a "C.I. Pigment Blue 15:3" was used instead of the "C.I. Pigment Orange 36".

Production of Green Toner

Production Examples of Green Toner "A1" to "F1" and "A2" to "F2"

Green toners "A1" to "F1" and "A2" to "F2" were produced in the same ways as those of Orange Toner Production Example 1 to Orange Toner Production Example 12 except that a "C.I. Pigment Green 7" was used instead of the "C.I. Pigment Orange 36".

Production of Cyan Toner

Production Examples of Black Toner "A1" to "F1" and "A2" to "F2"

Black toners "A1" to "F1" and "A2" to "F2" were produced in the same ways as those of Orange Toner Production Example 1 to Orange Toner Production Example 12 except that a "Carbon Black: Mogul L" (Cabot Corporation) was used instead of the "C.I. Pigment Orange 36".

(Preparation of Developer)

Orange developers "A1" to "F1" and "A2" to "F2", yellow developers "A1" to "F1" and "A2" to "F2", magenta developers "A1" to "F1" and "A2" to "F2", cyan developers "A1" to "F1" and "A2" to "F2", green developers "A1" to "F1" and "A2" to "F2" and black developers "A1" to "F1" and "A2" to "F2" were prepared by mixing each of the orange toners "A1" to "F1" and "A2" to "F2", yellow toners "A1" to "F1" and "A2" to "F2", magenta toners "A1" to "F1" and "A2" to "F2", cyan toners "A1" to "F1" and "A2" to "F2", green toners "A1" to "F1" and "A2" to "F2" and black toners "A1" to "F1" and "A2" to "F2" and a ferrite carrier, which is coated with methyl methacrylate and cyclohexyl methacrylate resin and volume-based median diameter of which is 50 μm, using a V-shaped mixer so as to be 6 w % of toner concentration.

(Evaluation)

The produced toners (developers) were evaluated as follows and the results were shown in Tablel and Table 2.

(Evaluation of Charge Amount)

A charge amount of the cyan developers "A1" to "F1" and "A2" to "F2" was determined by an electric field separation method as described below after leaving them stand in low-temperature and low-humidity condition (10° C. and 20% RH (Relative Humidity)) and high-temperature and high-humidity condition (30° C. and 80% RH) for 10 hours. The results are shown in Table 1.

It is considered to be acceptable when a difference of the charge amount at the low-temperature and low-humidity condition and at the high-temperature and high-humidity condition is 10 μC/g or smaller.

(Measurement of Charge Amount by Electric Field Separation Method)

The measurement of the charge amount using the electric field separation method is as follows.

(1) 30 g of a developer (produced by the method as described above) is charged in a 50 ml plastic bottle and the bottle is rotated at a rate of 120 rpm for 20 minutes.

(2) 1 g of the developer is fractioned and set on a magnet roller, and a counter electrode that is previously weighed is set.

(3) 1 kV of biased voltage of a polarity same as the toner polarity is applied and the magnet roller is rotated in that state at a rate of 500 rpm for one minute.

(4) After the rotation of the magnet roller, a voltage between the electrodes and the weight of the counter electrode are measured and the toner charge amount Q/M (μC/g) is calculated, where M (g) is a weight of the toner adhered to the counter electrode and Q is a product of capacity of a capacitor (1 μF) and the voltage (V) between the counter electrode.

TABLE 1

| | | CHARGE AMOUNT (μ C/g) | | |
|---|---|---|---|---|
| | TONER CYAN | LOW TEMPERATURE LOW HUMIDITY | HIGH TEMPERATURE HIGH HUMIDITY | DIFFERENCE |
| COMPARATIVE EXAMPLE 1 | [A1] | 42.3 | 30.2 | 12.1 |
| COMPARATIVE EXAMPLE 2 | [C1] | 41.2 | 25.3 | 15.9 |
| COMPARATIVE EXAMPLE 3 | [E1] | 40.2 | 22.4 | 17.8 |
| COMPARATIVE EXAMPLE 4 | [A2] | 39.2 | 24.4 | 14.8 |
| COMPARATIVE EXAMPLE 5 | [C2] | 38.8 | 21.2 | 17.6 |
| COMPARATIVE EXAMPLE 6 | [E2] | 35.8 | 19.5 | 16.3 |
| EXAMPLE 1 | [B1] | 44.3 | 43.3 | 1.0 |
| EXAMPLE 2 | [D1] | 45.2 | 43.4 | 1.8 |
| EXAMPLE 3 | [F1] | 43.1 | 40.2 | 2.9 |
| EXAMPLE 4 | [B2] | 43.9 | 43.2 | 0.7 |
| EXAMPLE 5 | [D2] | 46.3 | 45.2 | 1.1 |
| EXAMPLE 6 | [F2] | 45.2 | 42.9 | 2.3 |

It can be recognized from the results shown in Table 1 that a decrease of charge amount at the high-temperature and high-humidity condition in Examples 1 to 6 (present invention) can be reduced compared with those in Comparative examples 1 to 6.

(Evaluation of Color Gamut Area (Color Reproduction Area))

A commercially available Multi-functional peripherals (MFP) Bizhub Pro C500 (Konica Minolta Business Technologies, Inc) was modified to have six-color toner image forming units and the developers were introduced into the developing devices according to the combination shown in Table 2. Each combination was evaluated as follows.

Solid-filled images (2 cm×2 cm) of yellow single color (Y), magenta single color (M), cyan single color (C), red color (R), blue color (B) and green color (G) were formed under the atmosphere of 20° C. and 50% RH. Each color component was represented on a*-b* coordinates in the L*a*b* color space and the color reproduction area, that is, a color gamut area was determined. The color gamut area of the developer combination of Comparative Example 1 is normalized as 100 and it was evaluated that color gamut area of 110 or more was acceptable.

The L*a*b* color space is effectively used for representing colors by numeric values and L* coordinate represents the lightness, a* coordinate represents a red-green hue, and b* coordinate represents a yellow-blue hue. The values of a* and b* are measured using a spectrophotometer "Gretag Macbeth Spectrolino" (Gretag Macbeth), the standard illuminant D65 as a light source and a reflectance measurement aperture of Φ4 mm. The measurement wavelength range is 280 to 730 nm at 10 nm intervals, a viewing angle is 2° and a dedicated white tile is used as a standard.

TABLE 2

| | TONER | | | | | | COLOR GAMUT |
|---|---|---|---|---|---|---|---|
| | ORANGE | YELLOW | MAGENTA | CYAN | GREEN | BLACK | AREA |
| COMPARATIVE EXAMPLE 1 | (A1) | (A1) | (A1) | (A1) | (A1) | (A1) | 100 |
| COMPARATIVE EXAMPLE 2 | (C1) | (C1) | (C1) | (C1) | (C1) | (C1) | 98 |
| COMPARATIVE EXAMPLE 3 | (E1) | (E1) | (E1) | (E1) | (E1) | (E1) | 95 |
| COMPARATIVE EXAMPLE 4 | (A2) | (A2) | (A2) | (A2) | (A2) | (A2) | 110 |
| COMPARATIVE EXAMPLE 5 | (C2) | (C2) | (C2) | (C2) | (C2) | (C2) | 101 |
| COMPARATIVE EXAMPLE 6 | (E2) | (E2) | (E2) | (E2) | (E2) | (E2) | 98 |
| EXAMPLE 1 | (B1) | (B1) | (B1) | (B1) | (B1) | (B1) | 130 |
| EXAMPLE 2 | (D1) | (D1) | (D1) | (D1) | (D1) | (D1) | 128 |
| EXAMPLE 3 | (F1) | (F1) | (F1) | (F1) | (F1) | (F1) | 125 |
| EXAMPLE 4 | (B2) | (B2) | (B2) | (B2) | (B2) | (B2) | 137 |
| EXAMPLE 5 | (D2) | (D2) | (D2) | (D2) | (D2) | (D2) | 135 |
| EXAMPLE 6 | (F2) | (F2) | (F2) | (F2) | (F2) | (F2) | 130 |

As can be seen in Table 2, the color gamut areas of Examples 1 to 6 (present invention) are higher than the acceptable value and higher than any values of color gamut areas of Comparative Examples. Asa result, it was confirmed that Examples 1 to 6 showed excellent color reproducibility.

The present U.S. patent application claims the benefit of priority under the Paris Convention of Japanese Patent Application No. 2013-054726 filed on Mar. 18, 2013, in which all contents of this application are disclosed, and which shall be a basis of correction of an incorrect translation.

What is claimed is:

1. A toner for electrostatic image development comprising a toner particle that contains at least a binder resin, wherein the toner particle comprises a polymer having a structural unit represented by a following general formula (1) as the binder resin:

general formula (1)

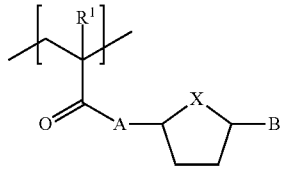

where $R^1$ represents a hydrogen atom or substituted or unsubstituted C1-C2 alkyl group, A represents an oxygen atom or divalent linking group, B represents a hydrogen atom, substituted or unsubstituted C1-C4 alkyl group, aldehyde group, carboxy group or hydroxy group, and X represents an oxygen atom, nitrogen atom or sulfur atom.

2. The toner for electrostatic image development of claim 1, wherein the X in the formula (1) represents an oxygen atom.

3. The toner for electrostatic image development of claim 1, wherein a content of the polymerizable monomer having the structural unit represented by the general formula (1) is 27% or larger and 70% or smaller by mass relative to a total amount of monomers composing the polymer.

4. The toner for electrostatic image development of claim 1, wherein the polymer is a copolymer that contains the structural unit represented by the general formula (1) and a structural unit derived from a (meth)acrylate ester-based monomer.

5. The toner for electrostatic image development of claim 4, wherein a molecular weight of the copolymer is 1500 to 60000.

6. The toner for electrostatic image development of claim 1, wherein the polymer is a copolymer that contains the structural unit represented by the general formula (1), a structural unit derived from a (meth)acrylate ester-based monomer, and a structural unit derived from a styrene-based monomer.

7. The toner for electrostatic image development of claim 6, wherein a molecular weight of the copolymer is 1500 to 60000.

8. A method for producing the toner for electrostatic image development of claim 1, comprising:

producing a monomer having a furfural structure, hydrogenating a furan ring of the furfural structure of the monomer produced at the monomer producing step, and polymerizing the monomers hydrogenated at the hydrogenating step to generate a polymer.

9. A method for producing the toner for electrostatic image development of claim 1, comprising:

producing a monomer having a furfural structure, polymerizing the monomers produced at the monomer producing step to generate a polymer, and hydrogenating furan rings of the furfural structures of the polymer generated at the polymerizing step.

10. An image formation method, comprising:

charging a photoreceptor, exposing the photoreceptor that is charged at the charging step to form an electrostatic latent image, developing the electrostatic latent image that is formed at the exposing step by using a toner for electrostatic image development, and transferring a toner image that is developed at the developing step onto a transfer material, wherein the toner for electrostatic image development is the toner for electrostatic image development of claim 1.

* * * * *